US008916041B2

(12) United States Patent
Van Den Berg et al.

(10) Patent No.: US 8,916,041 B2
(45) Date of Patent: Dec. 23, 2014

(54) BLENDING HYDROCARBON STREAMS TO PREVENT FOULING

(71) Applicant: Shell Oil Company, Houston, TX (US)

(72) Inventors: Franciscus Gondulfus Antonius Van Den Berg, Amsterdam (NL); Oliver Klaus Herzberg, Amsterdam (NL)

(73) Assignee: Shell Oil Company, Houston, TX (US)

( * ) Notice: Subject to any disclaimer, the term of this patent is extended or adjusted under 35 U.S.C. 154(b) by 91 days.

(21) Appl. No.: 13/718,777

(22) Filed: Dec. 18, 2012

(65) Prior Publication Data

US 2013/0161233 A1 Jun. 27, 2013

(30) Foreign Application Priority Data

Dec. 23, 2011 (EP) ..... 11195478

(51) Int. Cl.

| | |
|---|---|
| ***C10L 10/04*** | (2006.01) |
| ***C10G 75/00*** | (2006.01) |
| ***C10G 7/00*** | (2006.01) |

(52) U.S. Cl.

CPC ..... *C10L 10/04* (2013.01); *C10G 75/00* (2013.01); *C10G 7/00* (2013.01)

USPC ..... 208/14; 208/48 R; 208/48 AA; 208/370

(58) Field of Classification Search

CPC ..... C10G 9/12; C10G 9/16; C10G 75/00; C10G 2300/10; C10G 2300/20; C10L 10/04

USPC ..... 208/14, 48 R, 48 AA

See application file for complete search history.

(56) References Cited

U.S. PATENT DOCUMENTS

| | | | | |
|---|---|---|---|---|
| 4,828,674 | A * | 5/1989 | Forester | 208/48 AA |
| 4,927,519 | A * | 5/1990 | Forester | 208/48 AA |
| 5,871,634 | A | 2/1999 | Wiehe et al. | |
| 5,997,723 | A | 12/1999 | Wiehe et al. | |
| 7,329,635 | B2 * | 2/2008 | Dickakian et al. | 508/466 |
| 7,799,206 | B2 * | 9/2010 | Van Den Berg et al. | 208/14 |
| 7,813,894 | B2 | 10/2010 | Prasad et al. | |
| 7,833,407 | B2 | 11/2010 | Brons et al. | |
| 7,837,855 | B2 * | 11/2010 | Brons et al. | 208/48 R |
| 7,919,058 | B2 * | 4/2011 | Brons et al. | 422/211 |
| 7,951,340 | B2 * | 5/2011 | Brons et al. | 422/211 |
| 8,062,504 | B2 * | 11/2011 | Wright et al. | 208/48 AA |
| 8,425,761 | B2 * | 4/2013 | Wright et al. | 208/48 AA |
| 8,663,455 | B2 * | 3/2014 | Levine et al. | 208/48 AA |
| 2008/0047874 | A1 | 2/2008 | Brons et al. | |
| 2010/0116715 | A1 | 5/2010 | Cross et al. | |

OTHER PUBLICATIONS

Dufour, Javier, et al.; "Influence of Hydrocarbon Distribution in Crude Oil and Residues on Asphaltene Stability", Energy Fuels, vol. 24; pp. 2281-2286; published on web Oct. 27, 2009.

van Kerkvoort, W.J. et al., "Determination of Dry-Sludge Content of Fuel Oils: Development of the Shell Hot Filtration Test (SHFT)", Journal of the Institute of Petroleum, 1951, vol. 37, pp. 596-604.

* cited by examiner

*Primary Examiner* — Ellen McAvoy

(74) *Attorney, Agent, or Firm* — Charles W. Stewart

(57) ABSTRACT

A method of reducing the fouling propensity of a hydrocarbon feed stream having a Total Base Number based on ASTM method D2896-11 of less than 150 ppm and/or a P-value according to ASTM method D7060-09 of less than 1.15 which method comprises processing the feed stream such that the product obtained has a calculated Total Base Number of at least 150 ppm, a calculated P-value of at least 1.15 and a calculated Po-value higher than the FRmax of the feed stream, more specifically blending at least two hydrocarbon feed streams to prepare a blend having these properties.

8 Claims, No Drawings

BLENDING HYDROCARBON STREAMS TO PREVENT FOULING

This application claims the benefit of European Patent Application No. 11195478.0, filed on Dec. 23, 2011, the disclosure of which is incorporated by reference herein in its entirety.

The present invention relates to a method for blending hydrocarbon feed streams in such a way as to prevent fouling. Blending of feed streams can occur when crude oils are combined during supply to a refinery, during processing at the refinery and/or when blending various product streams in order to obtain the final product to be supplied to the end-user.

It is advantageous to be able to process a wide variety of feed streams in a refinery more specifically streams which are considered of lower value due to the quantity and/or kind of contaminants. However, such lower quality feed streams have an intrinsic risk as these can lead to fouling as well as to lower quality (intermediate) products. Fouling is especially disadvantageous in that it can lead to extra downtime for cleaning and/or may require mitigation steps such as adding surfactants to the feed to remove fouling.

Processing of oils frequently leads to fouling issues. Such fouling typically comprises particulate deposits formed in situ on a hot surface such as heat exchangers, so called hot fouling, or phase separation of asphaltenes by equilibrium changes and shifts in the colloidal system, resulting in settling and dropping out of hydrocarbonaceous material, so called cold fouling. This fouling may occur at exploration production sites and/or at processing sites such as in refinery oil movement and/or in refinery processing when the oil is in contact with heat exchangers.

It is desirable to be able to identify upfront the fouling propensity of hydrocarbon streams to be processed and/or blended in order to be able to anticipate potential detrimental effects, more specifically fouling.

U.S. Pat. No. 5,997,723 discloses a process for blending two or more petroleum oils, any component of which may be an unprocessed crude oil or a processed oil derived from petroleum, in a manner to minimize fouling and coking of refinery process equipment. The blending method includes the steps of determining the insolubility number, I, for each oil, determining the solubility blending number, S, for each oil, and combining the petroleum oils in the proportions in order to keep the solubility blending number of the mixture higher than 1.4 times the insolubility number of any oil in the mixture. The invention also includes selecting petroleum oils to minimize fouling.

U.S. Pat. No. 5,871,634 discloses a method for blending two or more petroleum feedstreams, petroleum process streams, or combination thereof, at least one of which includes the solute asphaltenes so that the asphaltenes remain a solute. The blending method includes the steps of determining the insolubility number, IN, for each feedstream, determining the solubility blending number, SBN, for each feedstream, and combining the feedstreams in order of decreasing SBN number of each feedstream such that the solubility blending number of the mixture is greater than the insolubility number of any component of the mix, when the solubility blending number of any of the feedstreams or streams is equal or less than the insolubility number of any of the streams.

U.S. Pat. No. 7,833,407 and US-A-2008/047874 disclose the blending of petroleum crude oils wherein a high solvency dispersive power (HSDP) crude oil or a high solvent power (HSP) crude oil, respectively, is added to a blend of incompatible oils to proactively address the potential for fouling heat exchange equipment. The HSDP or HSP component dissolves asphaltene precipitates and maintains suspension of inorganic particulates (HSDP component) before coking affects heat exchange surfaces. An HSDP oil or HSP oil is also flushed through heat exchange equipment to remove any deposits and/or precipitates on a regular maintenance schedule before coking can affect heat exchange surfaces. U.S. Pat. No. 7,833,407 thereby discloses use of the Total Acid Number of the HSDP oil as parameter to reduce fouling.

U.S. Pat. No. 7,813,894 discloses a methodology and system which addresses outstanding needs of refiners to process cheaper crudes or blends of crudes. This method and system comprises a number of steps, including characterizing the impact of various constituents in the crude which result in fouling of heat exchangers; estimating model parameters; monitoring and predicting qualitative and quantitative performance; and determining optimal dosage of chemical treatments. The key parameters used in the model are the diffusion coefficient, foulant concentration, reaction rate constant and the activation energy.

There still is a need for a further method and system wherein hydrocarbon streams are assessed and evaluated enabling a refinery to achieve further benefits by making more adequate decisions with regard to the purchase and/or intake and/or handling of hydrocarbon streams that induce fouling, in this way achieving better economics. An additional advantage can be a more systematic and simple approach to determine the optimal use of hydrocarbon streams for blending and/or processing without running the risk of fouling. There is also a need for a method to prevent fouling rather than to clean-up fouling when the damage is done.

Accordingly, the present invention provides a method that advantageously allows a reduction in fouling prior to as well as during the processing of hydrocarbon feed streams more specifically in the blending of crude oils prior to refining, during refining of crude oils and/or the blending of the various products such as fuel oils. The method as described herein enables the preparation of hydrocarbon streams having a low fouling propensity by appropriately selecting and blending hydrocarbon streams. Furthermore, the present invention has the advantage that the calculation of the properties of the blend can be done fast and in a straightforward way.

The present invention relates to a method of reducing the fouling propensity of a hydrocarbon feed stream having a Total Base Number of less than 150 ppm based on the Base Number determined according to ASTM method D2896-11 and/or a P-value according to ASTM method D7060-09 of less than 1.15 which method comprises determining the Total Base Number and P-value of the hydrocarbon feed stream and processing the feed stream such that the product obtained has a calculated Total Base Number of at least 150 ppm, a calculated P-value of at least 1.15 and a calculated Po-value higher than the FRmax of the feed stream.

The desired properties of the product can be obtained in various ways. One of them is by removing a light fraction from the hydrocarbon feed to obtain a product having a Total Base Number of at least 150 ppm, a P-value of at least 1.15 and a Po-value higher than the FRmax of the feed stream. This method has the advantage that both a valuable light fraction and a more stable heavy fraction are obtained. It depends on the properties of the feed stream whether it actually can be applied. A light fraction of the feed stream is a part of the feed stream containing the relatively low boiling compounds. The light fraction differs from the feed stream in that the temperature at which 50% wt of the light fraction has distilled is lower than the temperature at which 50% wt of the feed stream has distilled. Generally, the light fraction will be removed by distillation of the feed stream in which distillation the light fraction is removed as a top product and the remainder of the feed stream is removed as one or more bottom products. Although it is customary to subject hydrocarbon streams to distillation, the specifications of the present invention will require a different light fraction to be removed from the feed stream.

In most instances, the present invention will comprise blending at least two hydrocarbon feed streams of which at least one feed stream has a Total Base Number according to ASTM method D2896-11 of less than 150 ppm and/or a P-value according to ASTM method D7060-09 of less than 1.15 in order to prepare a blend of low fouling propensity which method comprises selecting the feed streams and their proportions such that the blend has a calculated Total Base Number of at least 150 ppm, a calculated P-value of at least 1.15 and a calculated Po-value higher than the FRmax of every feed stream.

The term "low fouling propensity" as used herein means that a blend or hydrocarbon feed streams produces substantially no fouling, preferably no fouling at all, during processing, storage and/or transport thereof, obviating the need to add anti-fouling chemicals.

Fouling typically constitutes hot fouling and cold fouling.

"Hot fouling" as used herein refers to the fouling that is caused by the in situ deposition of hydrocarbon-based particulate material on hot surfaces, like heat exchanger surfaces, during the processing of hydrocarbon streams.

"Cold fouling" as used herein refers to the agglomeration and flocculation of asphaltenes in time due to equilibrium changes and shifts in the colloidal system, for instance caused by excess stress and/or incompatibility.

Although many blending methods have been described, it was found that the present combination of specifications gives an especially good prediction of the hot and cold fouling which occurs in actual practice. Without wishing to be bound to any theory, it is thought that this is due to the fact that the combination not only predicts the amount of contaminants but also the amount of compounds which assists in keeping the contaminants in solution while taking into account the fact that dissimilar asphaltenes do not blend on a molecular scale. It appears that basic compounds inhibit built up of coke layers and thereby act as natural fouling inhibitors. The basic compounds appear to additionally inhibit the formation of iron sulfide which gives high temperature sulphur corrosion as an alternative fouling mechanism.

As described herein, at least two hydrocarbon feed streams are selected and blended in such a way that the blend has low fouling propensity in actual practice. It was surprisingly found that the combination of calculated Total Base Number, P-value and Po-value together have a very good predictive power for the hot and the cold fouling behavior of the hydrocarbon blend, especially when blending two or more low quality hydrocarbon streams.

At least one of the feed streams that are selected for use in the present invention is a low quality hydrocarbon stream, typically having a high fouling propensity.

Hereinafter we will discuss each of these parameters.

The Total Base Number (also known as Basic Nitrogen Level) is derived from the Base Number determined according to ASTM method D2896-11. ASTM method D2896-11 determines the Base Number in mg KOH/g which is converted to the Total Base Number in the following way:

$$TBN\ (ppm) = \frac{\text{Base Number (mg KOH/g)} \times 14\ \text{g/mol} \times 1000\ \text{g/kg}}{58.1\ \text{g/mol}}$$

The TBN is a measure of the reserve of alkalinity meaning its ability to neutralize acids. It is preferred that the calculated Total Base Number of the blend is at least 150 ppm, more preferably at least 180 ppm, more preferably at least 220 ppm, most preferably at least 250 ppm. The upper limit of the Total Base Number typically will not exceed a value of 400 ppm, more specifically 350 ppm, most specifically 300 ppm.

The other parameter for ensuring that the blend has low fouling propensity, is the so-called P-value of the blend.

Asphaltenes consist of aromatic and naphthenic ring compounds optionally containing nitrogen, sulfur and/or oxygen which compounds are considered to exist in oil as a colloidal suspension. The asphaltenes in a sample of oil can be made to become unstable by injecting a measured quantity of cetane. The asphaltene flocculation point is the point of instability. The P-value is considered to be the stability reserve and is defined as the ratio Po/FRmax which is the ratio of Peptizing Power to Maximum Flocculation Ratio. Both are determined experimentally according to ASTM method D7060-09. Po is a measure for the peptizing power of the oil phase or solubility number of maltenes. Maltenes constitute the fraction of asphalt which is soluble in n-alkane solvent. FRmax expresses the maximum flocculation ratio obtainable at a theoretical indefinite dilution. In other words, it denotes the minimal peptizing power required to keep the asphaltenes peptized.

For the present invention, the feed streams are selected and blended in such a way that the blend has at least 15% excess asphaltene stability, meaning that the blend should have a P-value of at least 1.15.

At least one of the feed streams used for blending is a low quality hydrocarbon stream having a Total Base Number of less than 150 ppm and/or a P-value of from 1.0 to 1.15. Most preferably, at least one of the feed streams is a low quality hydrocarbon stream having a Total Base Number of less than 150 ppm, more specifically less than 130, and a P-value of from 1.0 to 1.15, more specifically of from 1.0 to 1.10, most specifically of from 1.0 to 1.05.

Preferably, an asphaltene stability reserve of more than 15% is achieved meaning that the blend has a P-value of more than 1.15. More preferably, an asphaltene stability reserve of at least 20% is targeted, meaning that the blend should have a calculated P-value of at least 1.20, more specifically a calculated P-value of at least 1.25, more specifically at least 1.30, more specifically at least 1.35, most specifically at least 1.40. The upper limit of the P-value typically will not exceed a value of 2.50, more specifically 2.00.

The Total Base Number of the blend can be derived from the Total Base Number of each of the feed streams taking into account in a linear way the weight in which each of the feed streams will be present in the blend.

The P-value of the blend is calculated on the basis of the Po and FRmax-value of each of the feed streams and the volume and weight proportion to which each of the feed streams will be present in the blend.

Po was found to blend linearly by volume. Therefore, the Po, blend=$\Sigma$vi*Poi, where vi=volume fraction of each component.

The FRmax blends linear by weight, using the C7-asphaltene concentration as a weighing factor. Therefore, the FRmax blend=Σwi*FRmaxi*Ai/Σwi*Ai, where wi=weight fraction of component i and Ai=C7-asphaltenes content of component i.

In order to take into account the fact that it is likely that the asphaltene moieties will not mix on a molecular scale and that the properties of the individual asphaltene particles will be preserved, additionally the calculated Po of the blend should be higher than the highest FRmax of the individual feed streams.

The stability reserve of the blend reflects the solvency power of the blend as required for the asphaltenes to remain dispersed in the blend colloidal system and/or sufficient for preventing the asphaltenes from agglomerating to form a precipitate or sediment.

Hydrocarbon feed streams that may be used in the blending as described herein include crude oils as directly obtained from a ship or pipeline, crude oils which have been subjected to crude desalting, oil fractions and oil products such as fuel oils. The oil fractions can be obtained by atmospheric and optionally vacuum distillation, separation or solvent extraction. The oil products are obtained by suitable conversion and separation of the crude oils.

The term "blending" as used herein is used for blending any feed stream, and may encompass non-blending, i.e. excluding a particular hydrocarbon stream from blending when it is not regarded suitable to prepare a blend fulfilling a particular criterion to reduce or even prevent fouling.

The invention further provides a system for evaluating the risk of fouling during the processing and blending of hydrocarbon streams. The system may advantageously be used to predict the fouling propensity of hydrocarbon streams.

The system comprises a database storing relevant data of hydrocarbon streams to be processed and a predictive engine comprising a fouling propensity model for executing a prediction of the fouling propensity.

The data of hydrocarbon streams as stored in the database serve as input for the predictive engine. The data of hydrocarbon streams are determined on the basis of test protocols, and at least include data determined on the basis of the Total Base Number, being related to hot fouling, and P-value, Po-value and FRmax, being related to cold fouling.

The fouling propensity model is based on correlation analyses using a plurality of data, which plurality of data encompass various parameters of each of a plurality of hydrocarbon stream, the fouling impact of each of the plurality of hydrocarbon streams and various parameters on operating conditions of refineries.

What is claimed is:

1. A method of reducing the fouling propensity of a hydrocarbon feed stream, having a Total Base Number based on ASTM method D2896-11 of less than 150 ppm and/or a P-value according to ASTM method D7060-09 of less than 1.15, wherein said method comprises: determining the Total Base Number and the P-value of the hydrocarbon feed stream; and processing the hydrocarbon feed stream such that a product is obtained having a calculated Total Base Number of at least 150 ppm, a calculated P-value of at least 1.15 and a calculated Po-value higher than the FRmax of the feed stream, wherein said processing to obtain said product comprises (1) removing a light fraction from said hydrocarbon feed stream or (2) blending said hydrocarbon feed stream with another hydrocarbon feed stream.

2. A method according to claim 1, in which method a light fraction is removed from the hydrocarbon feed stream to obtain said product.

3. A method according to claim 1, which method comprises: blending at least two hydrocarbon feed streams of which at least one feed stream has a Total Base Number according to ASTM method D2896-11 of less than 150 ppm and/or a P-value according to ASTM method D7060-09 of less than 1.15 in order to prepare a blend of low fouling propensity; and selecting the at least two hydrocarbon feed streams such that the blend has a calculated Total Base Number of at least 150 ppm, a calculated P-value of at least 1.15 and a calculated Po-value higher than the FRmax of every feed stream.

4. The method of claim 3, which method comprises: selecting said at least two hydrocarbon feed streams such that the blend has a Total Base Number of at least 180 ppm.

5. The method of claim 4, which method comprises: selecting said at least two hydrocarbon feed streams such that the blend has a calculated Total Base Number of at least 220 ppm.

6. The method of claim 5, which method comprises selecting said at least two hydrocarbon feed streams such that the blend has a Total Base Number of at least 250 ppm.

7. The method of claim 3, comprising: selecting said at least two hydrocarbon feed streams in such a way that the blend has a P-value of at least 1.3.

8. The method of claim 3, comprising: selecting said at least two hydrocarbon feed streams in such a way that the blend has a P-value of at most 2.5.

* * * * *